US006223501B1

(12) United States Patent
Ringer

(10) Patent No.: US 6,223,501 B1
(45) Date of Patent: May 1, 2001

(54) TEAR OPEN PACKAGING

(76) Inventor: Wayne Ringer, P.O. Box 207, Wolcott, IN (US) 47980

( * ) Notice: Subject to any disclaimer, the term of this patent is extended or adjusted under 35 U.S.C. 154(b) by 0 days.

(21) Appl. No.: 09/437,056

(22) Filed: Nov. 9, 1999

Related U.S. Application Data

(60) Provisional application No. 60/107,636, filed on Nov. 9, 1998.

(51) Int. Cl.[7] ..... B65B 61/18; B65B 61/02

(52) U.S. Cl. ..... 53/412; 53/133.8; 53/442; 53/557; 53/559

(58) Field of Search ..... 53/133.6, 133.8, 53/412, 442, 453, 477, 557, 559; 206/469, 497; 493/63

(56) References Cited

U.S. PATENT DOCUMENTS

| | | | | |
|---|---|---|---|---|
| 3,660,962 | * | 5/1972 | Bliss et al. | 53/442 |
| 3,912,079 | * | 10/1975 | Selchow, Jr. | 206/497 X |
| 4,047,358 | | 9/1977 | Heffernan et al. . | |
| 4,757,900 | * | 7/1988 | Misset et al. | 206/497 |
| 4,958,735 | * | 9/1990 | Odabashian | 206/497 |
| 4,969,309 | * | 11/1990 | Schwarz et al. | 53/412 |
| 5,177,931 | * | 1/1993 | Latter | 53/133.8 X |
| 5,408,807 | * | 4/1995 | Lane, Jr. et al. | 53/133.8 X |
| 5,671,589 | * | 9/1997 | Irvine et al. | 53/133.8 X |

FOREIGN PATENT DOCUMENTS

| | | | |
|---|---|---|---|
| 2247666 | * | 3/1992 | (GB) . |
| 4-72162 | * | 3/1992 | (JP) . |

* cited by examiner

*Primary Examiner*—Stephen F. Gerrity
(74) *Attorney, Agent, or Firm*—Sheldon H. Parker

(57) ABSTRACT

A perforating apparatus for use in the formation of shrink film packages is disclosed. The apparatus comprises a bottom seal tool with a plurality of peninsula regions forming a plurality of window areas. Each pair of window areas has a knife receiving area to receive a knife retaining block. The retaining block contains a perforation knife that extends beyond the surface of the sealing tool a sufficient distance to perforate the packages. At least one screw member extends through the peninsula, contacting the retaining block and securing the retaining block within the retaining channel. A change plate, having slots dimensioned and located to receive the knife blades is placed over the sealing tool surface. The packages are placed on the change plate and sealed by contacting the package with the upper platen. The upper platen is provided with a nonconductive material positioned to receive the knife blade. The resulting package has a perforation through the paperboard extending from one edge to the plastic window. This perforation enables the package to be easily opened.

21 Claims, 3 Drawing Sheets

TEAR OPEN PACKAGING

CROSS-REFERENCE TO RELATED PATENT APPLICATION

The present application claims the benefits under 35 U.S.C. 119(e) of provisional patent application Ser. No. 60/107,636, filed Nov. 9, 1998. This application incorporates by reference, as though recited in full, the disclosure of co-pending provisional patent application Ser. No. 60/107,636.

BACKGROUND OF THE INVENTION

1. Field of the Invention

The invention relates to a tear open system for a package, particularly a perforated tear open system for plastic film packages that combines a cardboard form and a plastic window. More particularly, the tear open system relates to a system for providing easy access to the contents of a shrink film package.

2. Brief Description of the Prior Art

The method and apparatus for forming shrink filmed display packages has been disclosed in a variety of patents and other publications. It is known to seal articles in pockets that are formed and sealed in plastic windows of paperboard blanks. These blanks have one or more openings that are covered, on one surface, by a heat-deformable and heat-sealable plastic sheet. The pockets are formed by heating the plastic material extending across the windows and deforming this plastic material to form a pocket. After the article is placed in the pocket, the pocket is closed, for example by folding the blank about a fold line and then heat sealing the plastic material. As the plastic sheet or film which is used is generally transparent, the article is provided in a decorative package in which it is sealed but nevertheless is fully visible. The teachings are best described, however, in U.S. Pat. No. 4,047,358, Method for Forming Article-Holding Display Packages, to Heffeman et al. The disclosures of this patents is incorporated herein by reference, as though recited in full.

As popular as these packages are, there have always been problems regarding the difficulty in opening the packages. The weight of cardboard required to maintain the integrity of the package makes opening the package by tearing the cardboard difficult. Separating the adhesive to pull open the package is also a problem as the adhesive is intended to maintain the two halves of the package adjacent one another.

The disclosed method and apparatus provides an easy opening mechanism in these popular paperboard packages.

SUMMARY OF THE INVENTION

A perforating apparatus for use in the formation of shrink film packages is disclosed. The apparatus comprises a bottom seal tool with a plurality of peninsula regions forming a plurality of window areas. Each pair of window areas has a knife receiving area to receive a knife retaining block. The retaining block contains a perforation knife that extends beyond the surface of the sealing tool a sufficient distance to perforate the packages. At least one screw member extends through the peninsula, contacting the retaining block and securing the retaining block within the retaining channel. A change plate, having slots dimensioned and located to receive the knife blades is placed over the sealing tool surface. The packages are placed on the change plate and sealed by contacting the package with the upper platen. The upper platen is provided with a nonconductive material positioned to receive the knife blade. The resulting package has a perforation through the paperboard extending from one edge to the plastic window. The terms paperboard and press board are used herein to include any form of self-supporting paper that is used in packaging. This perforation enables the package to be easily opened.

DESCRIPTION OF THE PREFERRED EMBODIMENTS OF THE INVENTION

Figure 2:
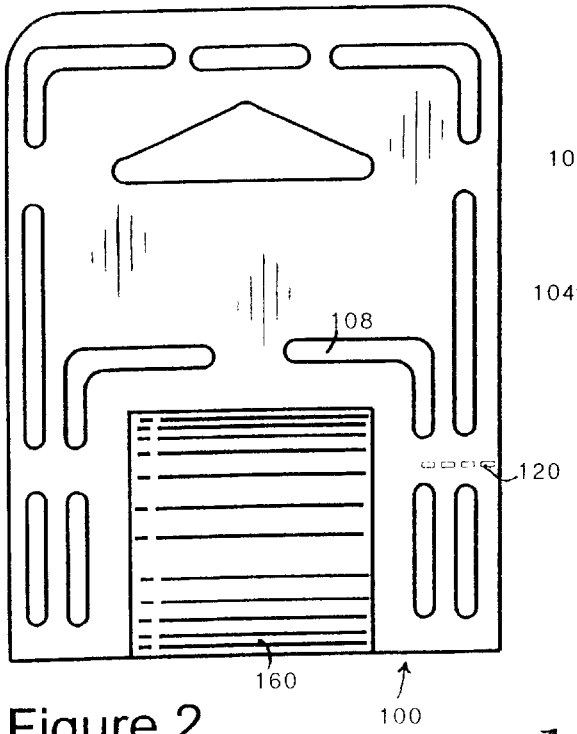
FIG. 2, is a side view of a formed package.

While the known packaging machines provide a satisfactory product, there has is a need for the ultimate user of the package to be able to readily open the package. Not only is this applicable to people with arthritis, are known to have particular problems with opening of sealed packages, but in instances where there a large number of packages to open. Places such as construction sites have a large number of packages to open and the ease of opening the disclosed package saves substantial time. Although the package is easy to open, it is impossible to hide any tampering of the package. Items that are easily damaged can be placed within the package without risk since the ease of opening prevents the contents from being damaged. Damage is also prevented to the user as the package does not require the use of scissors, knives or other sharp objects to puncture the plastic or cut the paperboard.

The disclosed package perforation apparatus and system enables the placement of the perforation on the package to be customized to suit the particular package design; the longer the perforation, the easier the opening. The packages manufactured in accordance with the disclosed system have the advantage of providing an easy open package while preserving the tamper protection of an unperforated product. This is especially advantageous when the packages are manufactured from heavy weight paperboard. The prior art opening difficulties are in the paperboard since plastics typically tear easily once a tear has been started. The disclosed system is adaptable to existing tooling, and will work with stand up, frame view, one sided and other standard package forms. The blank and receiving pocket are formed by any means currently used by the manufacturer.

The full details of the manufacture of a shrink film package is fully disclosed in the prior art, as noted above, and made a part of the present invention. Generally, depending upon design, the package consists of two layers of cardboard material and one or two layers of plastic shrink film. It is noted that the paperboard used in the process can be of any thickness, as well known in the art, and can be recycled, virgin, or any of the materials commonly in use. The film can be Dupont brand Surlyn®, PVC, and other flexible films.

The disclosed process involves indexing the package to a seal station, followed by folding the package loaded with an article. The lower seal station is then locked into the up position. Serrated knives, protruding through the change plate slots in the lower seal, raise the package approximately 1/32 of an inch, depending upon the depth of cut required. The upper platen in the sealing tool presses the package down onto the knives, thereby causing the lower knives to penetrate the layers of material. Slots in the change plate are dimensioned to receive the knives and a non-conductive material in the upper platen enable the knives to completely penetrate the paperboard, thereby perforating the package for easy opening. The perforation step is preferably performed at the seal station, simultaneous with the sealing step, enabling the front and backsides of the folded card to be cut simultaneously. Cutting prior to the folding operation necessitates extremely careful registration of the two sets of perforations, and would require a double set of knives. Additionally, perforation at the time of sealing also provides the additional function of facilitating the venting of air from the pocket during the shrinking step.

Figure 1:
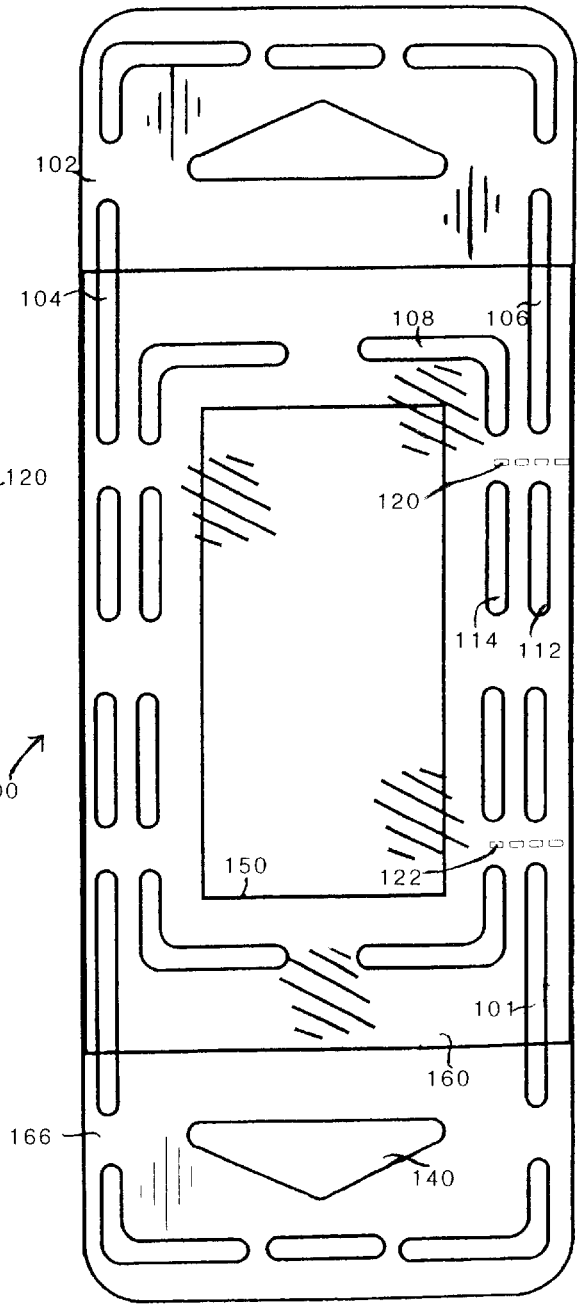
FIG. 1 is a plan view, of a package in the open position, showing seal lines that would not be visible prior to forming the package.
Figure 5:
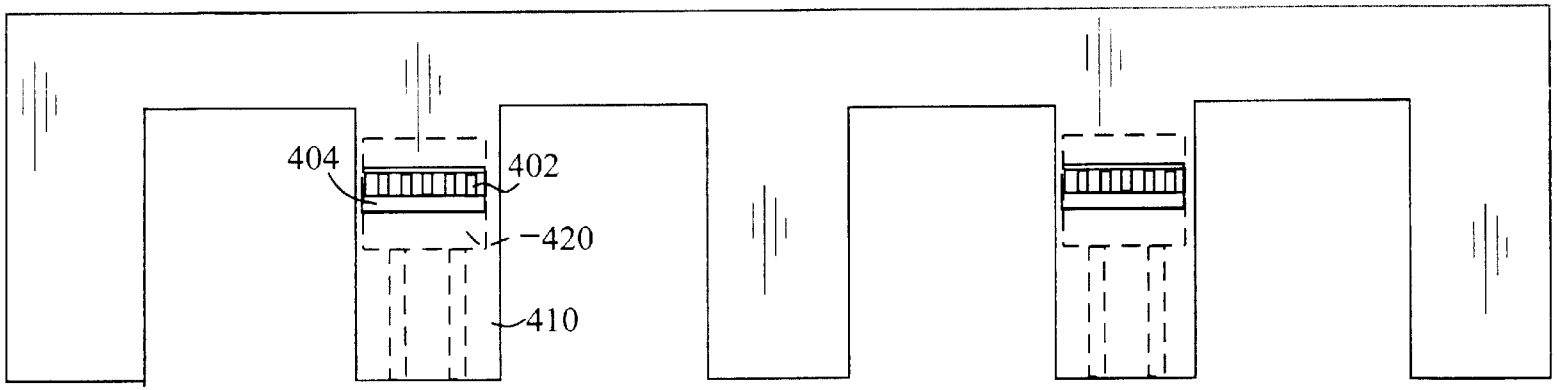
FIG. 5 is a plan view of the upper surface of the bottom sealing tool.

FIG. 1 shows a package, indicated generally as 100, as it would appear if it were reopened after the complete process. Prior to sealing, the seal lines indicated for example as 108, 106 112, 114, and 104, would not be evident, nor would the perforations 120 and 122.

Opening 140 is provided for the hanging of the package from a display hook. Although the film 160 is typically of the same width as the paperboard 166, this is not critical. It is critical, however, that the film 160 fully covers the window 150 in the paperboard 166.

The seal lines are typically not continuous, as evidenced by the spaces such as 102, to enable the evacuation of trapped air. In addition to increasing the ease of opening the package, the perforations 120 and 122 greatly facilitate the venting step. The perforations 120 and 122 do not vent air to the outer edge of the frame 166, but rather through the surface of the paperboard. Air is not, therefore, required to evacuate through the areas being compressed.

Figure 3:
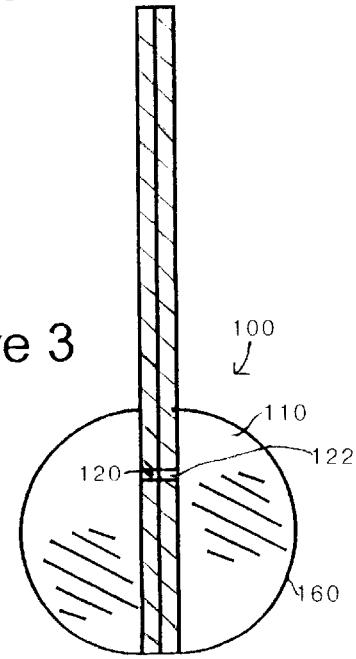
FIG. 3, is a end view, partly in cross-section, of the package of FIG. 2.

FIG. 2 shows the package, indicated generally as 100, folded and in its final form. The film 160 has been shrunk to conform to the shape of the enclosed article. In FIG. 3, the sealed package 100, housing a cylindrical object 110, is shown from the side view, illustrating the perforations 120 and 122. The perforations 120 and 122 have been simultaneously cut and provide for easy access to the article within the package.

Figure 4:
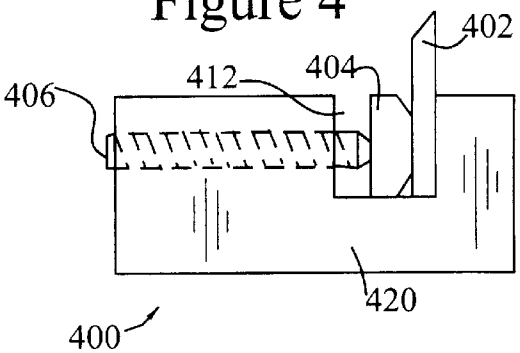
FIG. 4 is a cut away side view of the knife retaining block.

FIGS. 4 illustrates the knife retaining block 420 with a knife blade 402 mounted in the receiving slot 412. To enable the set screws 406 to rigidly maintain the knife blade 402 in position without damage, a brace bar 404 is typically employed between the perforation knife blade 402 and set screws 406. As seen in this figure, a slot 412 within the striker plate 400 is dimensioned to receive the knife blade 402 and brace bar 404. The depth of the slot 412 is less than the height of the knife blade 402 to enable the blade 402 to perforate the paperboard 166. The width of the notch 412 will be dependent upon the system being used and will be evident to those skilled in the art. It should be noted that the slot 412 can be placed at any position along the body of the retaining block 420, or that the block 420 can be reversed, to alter the cutting position of the knife blade 402 relative to the package.

The knife retaining block 420 is placed into a receiving area within the bottom seal tool 510. One or more channels 410 are drilled into the seal tool 510, generally at right angles to the receiving area, to receive the screws that secure the retaining block 420 within the seal tool 510.

The receiving area within the bottom seal tool can be positioned appropriately to position the knife to the desired position and the manufacture of the receiving area with the tool will be known in the art. It should be noted that the knife blade 402 must extend beyond the surface of the bottom seal tool 510 a sufficient distance to enable the knife blade to 402 completely penetrate the package and come in contact with the receiving material 652 of the upper platen 650.

Figure 6:
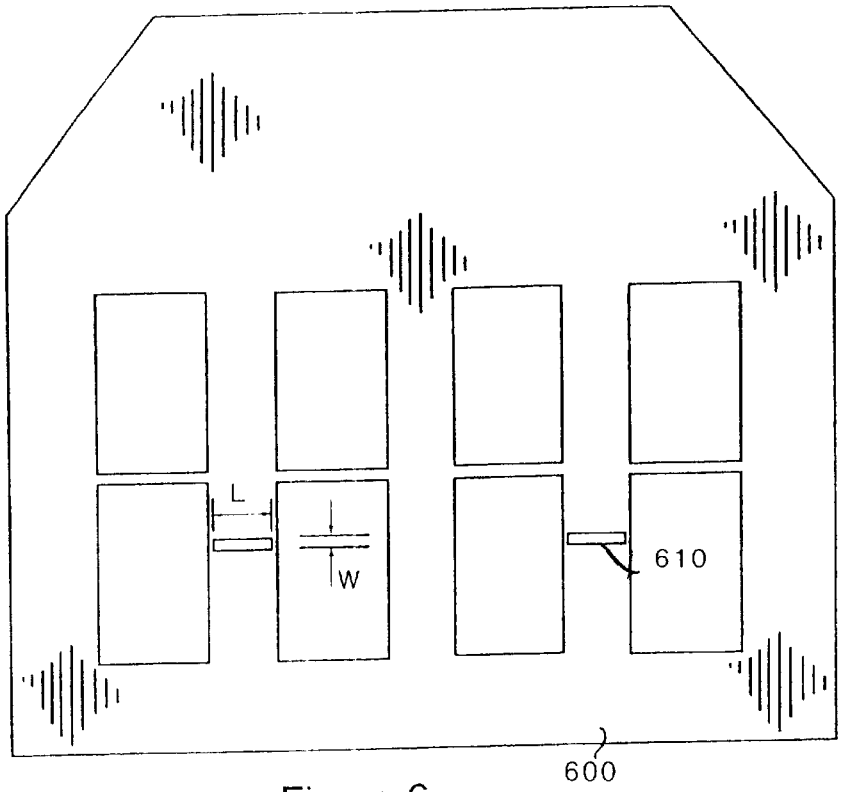
FIG. 6 is a plan view of the change plate of the package forming apparatus.

FIG. 6 shows a change plate 600 for simultaneously forming four frame packages. The change plate 600 has a pair of slots 610, for receiving the knife blade 402 and enabling the perforation of the four packages. The slots 610 can be about 0.125 inch wide by about and inch and one quarter long, in a typical installation. The exact dimensions are not narrowly critical and are dependent upon the size, shape and configuration of the knife blades 402. The exact location of the slots 610 must always properly align with the knife blades 402 to enable the perforating process to work effectively. Both the bottom seal tool and/or the change plate can be readily interchanged on the sealing device to handle blanks of different shapes and with different dimensions of pockets, by simply removing the holding screws that hold the change plate and seal tool in place.

Figure 8:
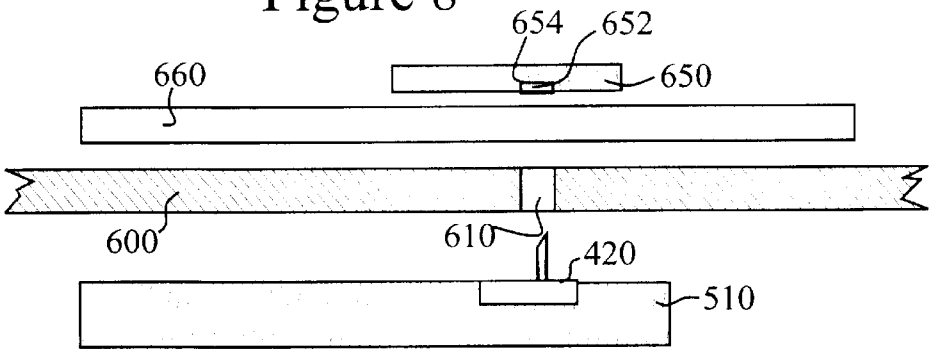
FIG. 8 is a cutaway side view of the bottom sealing tool, change plate, package and upper platen.
Figure 7:
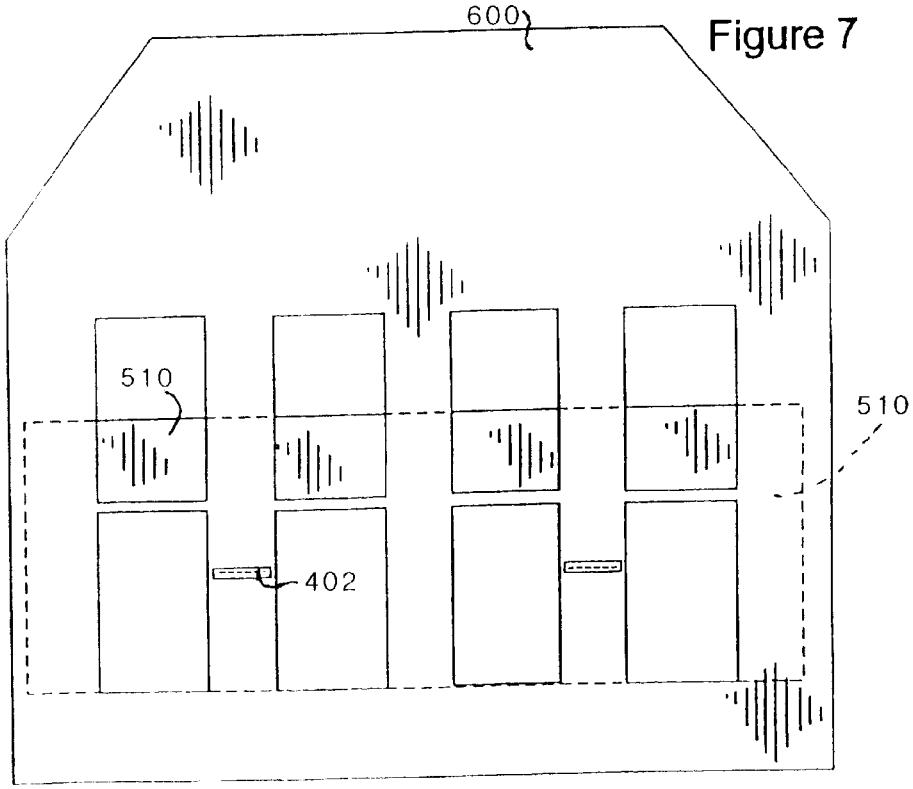
FIG. 7 is a plan view of the change plate and upper platen in an overlying relationship, but without a package in position between the change plate and seal tool

FIGS. 7 and 8 show the change plate 600 and the upper platen 650 sealing and perforating the packages. The upper platen 650 has a receiving area 654 containing a nonconductive material 652 to receive the knife blades 402. The receiving area 652 must align with the knife blades 402 to ensure that the knife blade 402 complete penetrates the packaging 660. To enable a single platen to be used with different knife blade alignments, the receiving area can be enlarged. This also makes the alignment less critical during the machining and assembly process. As can be seen the slots 610 are aligned to enable the knife blade 402 to perforate the package, extending through the slots 610 into the upper platen receiving material 652. It should be understood that during the actual operation of the machinery the two elements would be separated by the material of the package 660, as illustrated in FIG. 8. The package is not shown in FIG. 7, for purposes of clarity only, and it not intended to depict the actual operation of the system.

What is claimed is:

1. A perforation apparatus for use in the formation of shrink film packages, comprising:

a knife retaining block, said knife retaining block having a receiving slot, said receiving slot being dimensioned to receive a knife blade, and at least one retaining member, said at least one retaining member maintaining said knife blade within said slot;

a planar member, said planar member having a plurality of peninsula regions forming a plurality of window areas, at least one peninsula region adjacent each pair of said plurality of window areas having a retaining block receiving area, said receiving area extending substantially across said peninsula region and being dimensioned to receive said knife retaining block, a change plate, said change plate having knife receiving slots dimensioned to receive said knife blade, a sealing member, said sealing member having a knife receiving area.

2. The perforation apparatus of claim 1, further comprising at least one screw member, said screw member extending through said peninsula region and contacting said knife retaining block, thereby securing said retaining block in said retaining block receiving area.

3. The perforation apparatus of claim 2, wherein said at least one screw member is a pair of parallel screws spaced apart from each other for applying pressure to said retaining block at two spaced apart locations.

4. The perforation apparatus of claim 1 further comprising a brace bar, said brace bar being adjacent said perforation knife within said knife retaining block.

5. The perforation apparatus of claim 4 wherein said at least one retaining member contacts said brace bar, thereby securing said perforation knife and said brace bar within said receiving slot.

6. The perforation apparatus of claim 5, wherein said at least one retaining member is a pair of parallel screws spaced apart from each other for applying pressure to said brace bar at two spaced apart locations.

7. The perforation apparatus of claim 1 wherein said knife receiving area is a nonconductive material recessed within said sealing member.

8. The perforation apparatus of claim 1 wherein said knife blade is about at right angles to said package's edge.

9. A device for fabricating a shrink film package comprising, in combination:

a heat sealing element for applying sufficient heat to a paperboard and plastic film package to seal together two layers of heat shrinkable plastic film, said heat sealing element making intermittent contact with said plastic film to produce an intermittent seal line, a perforation apparatus for retaining and perforating a plurality of package units in position within said device, a planar member, said planar member having a plurality of peninsula regions forming a plurality of window areas, at least one peninsula region adjacent each pair of said plurality of window areas having a knife block retaining area, said knife block retaining area extending substantially across said peninsula region, and a knife block, said knife block having a receiving slot, said receiving slot being dimensioned to receive a knife blade, and a retaining member, said retaining member maintaining said knife blade within said slot, a change plate, said change plate having knife receiving slots dimensioned to receive said knife blade, a sealing member, said sealing member having a recessed knife receiving area, wherein said knife blade extends into said sealing member knife receiving area to produce a line of perforations in said paperboard in a direction across said intermittent seal line.

10. The device of claim 9 wherein said line of perforations in said plastic film is substantially at a right angle to said intermittent seal line.

11. The device of claim 9 wherein said line of perforations crosses said intermittent seal line in an unsealed area.

12. A shrink film package, said package having a plastic window region, an intermittent heat seal line, and a perforation line, said perforation line extending substantially from a peripheral edge of said package to a window region, said line of perforations in said package being at about a right angle to said intermittent seal line and crossing said intermittent seal line in an unsealed area.

13. The shrink film package of claim 12, wherein said package is a paperboard member and said window region is a heat shrink plastic film, said plastic film being sealed to said paperboard by a plurality of heat seals formed in an intermittent series, said perforation line extending from said peripheral edge to said window region in a region without heat seals.

14. The method of forming perforated tear openings in paperboard packages comprising the steps of:

sealing a heat formable, heat sealable plastic sheet to a paper blank, said paper blank having peripheral edges and a window within said peripheral edges, said window being covered by said plastic sheet, said plastic sheet having peripheral dimensions that are substantially greater than the peripheral dimensions of said window, said plastic sheet being sealed to said paper blank in the region of said plastic sheet between the peripheral edges of said window and the peripheral edges of said paper blank and having at least one seal line that extends parallel to at least one of said peripheral edge of said window or said paper blank; applying heat to said plastic sheet and forming an article receiving pocket in said plastic sheet, said article receiving pocket extending through said window; inserting an article into said article receiving pocket; applying pressure to said paper blank with a perforation knife and forming perforations through said paper blank and said plastic sheet, said perforations extending substantially from a peripheral edge of said paper blank, across said at least one seal line to a peripheral edge of said window, whereby said perforations form a tear mechanism for tearing said paperboard and said plastic sheet and providing access to said article in said window.

15. The method of claim 14, wherein said seal line is formed by heat sealing said plastic to said paper board along an intermittent seal line, said perforations crossing said seal line in an unsealed region of said intermittent seal line.

16. The method of claim 14, further comprising the step of forming said article receiving pocket in said plastic sheet by applying a vacuum to said window region of said plastic sheet.

17. The method of claim 16, further comprising the step of folding said paper blank subsequent to said step of forming said article receiving pocket in said plastic sheet.

18. The method of claim 17, wherein said step of folding said paper blank is prior to said step of applying pressure to said paper blank with a perforation knife and forming perforations through said paper blank and said plastic sheet.

19. The method of claim 16, wherein said step of forming said article receiving pocket is prior to said step of applying pressure to said paper blank with a perforation knife.

20. The method of claim 14, further comprising the step of tearing open said paperboard package by applying a tearing force to said package and tearing said paperboard and said plastic sheet from a peripheral edge of said package to said window.

21. The method of claim 14, further comprising the step of folding said paper blank prior to said step of applying pressure to said paper blank with a perforation knife.

* * * * *